United States Patent [19]

Hashimoto

[11] Patent Number: 4,544,863

[45] Date of Patent: Oct. 1, 1985

[54] POWER SUPPLY APPARATUS FOR FLUORESCENT LAMP

[76] Inventor: Ken Hashimoto, 1-15-17, Komachi, Kamakura-shi, Kanagawa-ken, Japan

[21] Appl. No.: 592,173

[22] Filed: Mar. 22, 1984

[51] Int. Cl.[4] ..... H05B 37/02

[52] U.S. Cl. ..... 315/209 R; 315/223; 315/224; 315/244; 315/245; 315/289; 315/DIG. 7

[58] Field of Search ..... 315/209 R, 223, 224, 315/244, 245, 289, DIG. 7

[56] References Cited

U.S. PATENT DOCUMENTS

| | | | |
|---|---|---|---|
| 3,084,283 | 4/1963 | Grunwaldt | 315/283 |
| 3,644,780 | 2/1972 | Koyama et al. | 315/DIG. 7 |
| 4,053,813 | 10/1977 | Kornrumpf | 315/206 |
| 4,207,497 | 6/1980 | Capewell | 315/223 |
| 4,259,614 | 3/1981 | Kohler | 315/DIG. 7 |

*Primary Examiner*—Harold Dixon

*Attorney, Agent, or Firm*—Jordan and Hamburg

[57] ABSTRACT

A power supply apparatus for a fluorescent lamp comprises an inverter circuit for converting AC line power to a high-frequency drive voltage having a square waveform, this high-frequency drive voltage being applied to a fluorescent lamp through an inductor and a capacitor connected in series to form a series-resonance circuit which provides a ballast impedance after ignition of the fluorescent lamp has been achieved. A sufficiently high voltage to ensure reliable ignition of the fluorescent lamp is ensured by a ringing oscillation which is produced across another capacitor, connected across the lamp, when the fluorescent lamp is in the high-impedance state prior to ignition.

3 Claims, 6 Drawing Figures

POWER SUPPLY APPARATUS FOR FLUORESCENT LAMP

BACKGROUND OF THE INVENTION

Prior to ignition (i.e. prior to a state of ionization being established), a fluorescent lamp has a very high impedance, whereas the impedance falls to a much lower value after ignition takes place. Thus, such a lamp has a form of negative-resistance characteristic. For this reason, it is necessary to insert some form of ballast impedance in series with a fluorescent lamp, e.g. a resistor or inductor, in order to ensure stable operation. However due to the change in impedance which takes place upon ignition of the fluorescent lamp, a substantial voltage drop is produced across such a ballast impedance when the lamp is in operation. That is to say, a much higher voltage must be applied to the combination of fluorescent lamp and ballast than is actually required to operate the lamp after ignition has been established. Typically, the applied voltage may be as much as twice the value of voltage which is required to operate the lamp, so that a substantial amount of power is wasted by such a ballast impedance.

In recent years, a method of supplying power to fluorescent lamps has come into use whereby the lamp is driven by a high-frequency drive voltage generated by a semiconductor inverter circuit. The output voltage from the inverter is generally boosted by a step-up transformer, and in this case the necessary ballast impedance may be provided by the leakage inductance of the transformer. However even with such an arrangement, the output voltage from the transformer prior to ignition is generally of the order of twice the voltage actually required to operate the lamp following ignition, so that again a substantial amount of power loss is incurred. As a result of this, it has only been found possible to attain an increase in efficiency of operation of a fluorescent lamp, using such a high-frequency drive voltage method, of the order of 20%, by comparison with conventional drive methods.

There is therefore a requirement for means for supplying power to a fluorescent lamp whereby it will not be necessary to apply a drive voltage, prior to ignition of the lamp, which is considerably greater than the voltage actually required to operate the lamp after ignition is achieved, but whereby ignition will be rapidly and reliably established. Such means are provided by a power supply apparatus for a fluorescent lamp according to the present invention.

SUMMARY OF THE INVENTION

A power supply apparatus for a fluorescent lamp according to the present invention essentially comprises an inverter circuit for converting the AC line power to a high-frequency drive voltage having a square waveform, a series-connected combination of an inductor and a first capacitor through which the high-frequency drive voltage is applied to the fluorescent lamp, and a second capacitor which is effectively connected across the fluorescent lamp. The values of the inductor and the first capacitor are selected such as to form a series-resonant circuit whose resonant frequency is higher than the frequency of the high-frequency drive voltage but is less than twice that frequency. In this way, the combination of the first capacitor and the inductor serve as a low value of ballast impedance, after ignition has been established. The value of the second capacitor is selected such as to form a resonant circuit, in combination with the inductor, such that a ringing voltage (i.e. a damped high-frequency oscillation) is produced across the second capacitor, and hence across the fluorescent lamp, upon each voltage transition of the high-frequency drive voltage, when the fluorescent lamp is in the high-impedance state prior to ignition. The peak value of the ringing voltage thus generated is sufficiently high to ensure reliable ignition of the fluorescent lamp, in spite of the fact that the level of the high-frequency drive voltage is only slightly higher than that required to operate the fluorescent lamp after ignition. In this way, the wastage of power in the necessary ballast impedance is reduced to a far lower level than has been possible with prior art methods of supplying fluorescent lamps, while at the same time rapid and completely reliable ignition of the fluorescent lamp is ensured.

As a result, a power supply apparatus for a fluorescent lamp according to the present invention can provide a very substantial reduction in the energy consumption of a fluorescent lamp, while employing very simple and easily implemented circuit means, as will be made clear by the following description of the preferred embodiments.

DESCRIPTION OF THE PREFERRED EMBODIMENTS

Figure 1:
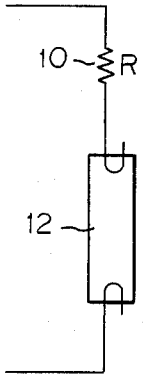
Fig. 1 PRIOR ART
FIGS. 1, 2 and 3 are circuit diagrams for illustratng prior art means for providing a ballast impedance for a fluorescent lamp.
Figure 2:
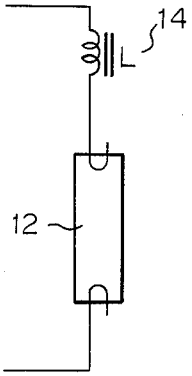
Fig. 2 PRIOR ART

Due to the negative-resistance characteristic of a fluorescent lamp, it is necessary to provide some form of ballast impedance in series with the lamp. In the prior art, such ballast impedance may comprise a resistor 10 connected in series with a fluorescent lamp 12 as shown in FIG. 1, or an inductor 14 as shown in FIG. 2. In either case, the supply voltage which is applied across the series-connected combination of ballast impedance and fluorescent lamp must be high enough to ensure reliable ignition of the fluorescent lamp, i.e. must generally have a value which is approximately twice the voltage required to drive the fluorescent lamp after ignition is achieved. In other words, after ignition takes place, a value of voltage approximately equal to that developed across lamp 12 is wastefully dropped across resistor 10 or inductor 14. As a result, a substantial amount of energy is wasted with such an arrangement.

Figure 3:
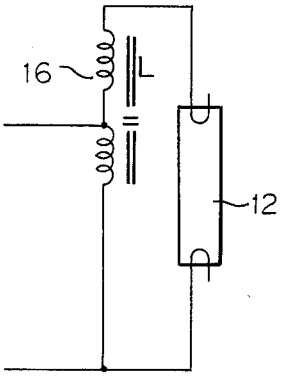
Fig. 3 PRIOR ART

In the case of the arrangement shown in FIG. 3, a drive signal such as a high-frequency drive voltage from an inverter is input to an auto-transformer 16, and the stepped-up output voltage from this transformer is applied to fluorescent lamp 12. However here again, in order to ensure stable operation of the lamp, it is necessary to provide a high degree of leakage inductance in transformer 16 to act as a ballast impedance after ignition of the fluorescent lamp takes place. As a result, the no-load output voltage from transformer 16 (i.e. prior to ignition of fluorescent lamp 12) must be of the order of twice the voltage which appears at the transformer output when the fluorescent lamp is in operation. Thus, a substantial amount of energy is wasted to operate the fluorescent lamp with this arrangement also.

Figure 4:
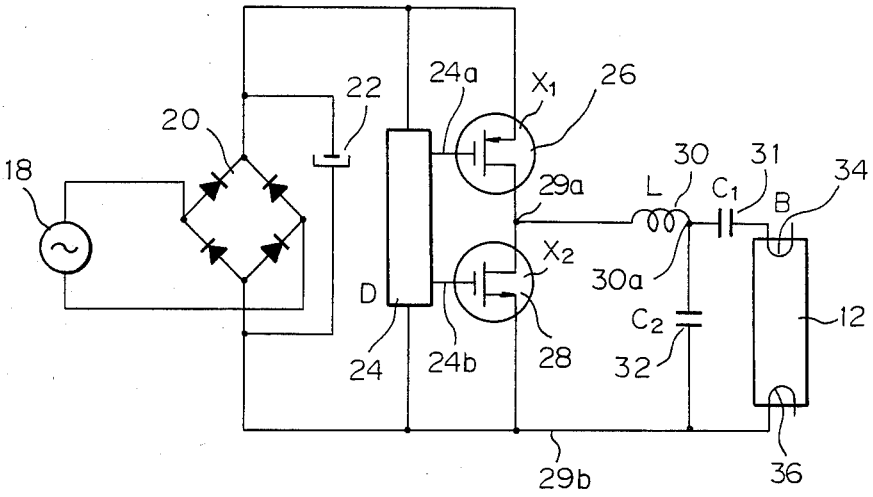
FIG. 4 is a general circuit diagram of a first embodiment of a power supply apparatus for a fluorescent lamp according to the present invention.

Referring now to FIG. 4, a general circuit diagram of an embodiment of a power supply apparatus for a fluorescent lamp according to the present invention is shown. Numeral 18 denotes a source of AC line power, which is rectified by a bridge rectifier circuit 20 to produce a DC supply which is smoothed by a smoothing capacitor 22. This DC supply is applied to a DC-to-AC inverter circuit 24, which generates high-frequency drive signals differing in phase by 180°, that are output on lines 24*a* and 24*b*. These drive signals are applied to the gate electrodes of FET transistors 26 and 28, connected in series across the DC supply voltage, whereby a square-wave high-frequency drive voltage is produced from outputs 29*a* (i.e. the junction point of transistors 26 and 28) and 29*b*. This high-frequency drive voltage is applied through an inductor 30 and capacitor 31 to opposing filaments 34 and 36 of a fluorescent lamp 12. In addition, a second capacitor 32, having a relatively low value of capacitance as described hereinafter, is connected between the junction of inductor 30, capacitor 31 and filament 36 of fluorescent lamp 12. The combination of inductor 30 and capacitor 31 forms a series-resonance circuit, whose resonant frequency is close to but not equal to the frequency of the high-frequency drive voltage, so as to provide a predetermined amount of series impedance, i.e. ballast, when the fluorescent lamp is in operation. Designating the value of inductor 30 as L, that of capacitor 31 as C and the frequency of the high-frequency drive voltage as F, then it has been found that in order to provide a sufficient level of ballast impedance from this series-resonance circuit, the component values should meet the following relationship:

$$1.2F < \tfrac{1}{2}\pi\sqrt{LC1} < 2f$$

It has been found that if the resonant frequency of this series-resonance circuit is made greater than twice the frequency F of the high-frequency drive voltage, then peak current values will flow which will be sufficiently high to damage the filaments of fluorescent lamp 12. If on the other hand the resonant frequency of the series-resonance circuit is made lower than frequency F of the high-frequency drive voltage, then the polarity of the high-frequency drive voltage will change during each half-cycle before capacitor 31 has been completely charged. As a result, the potential applied to fluorescent lamp 12 will be reduced on the succeeding half-cycle, so that stable operation cannot be ensured.

Figure 5:
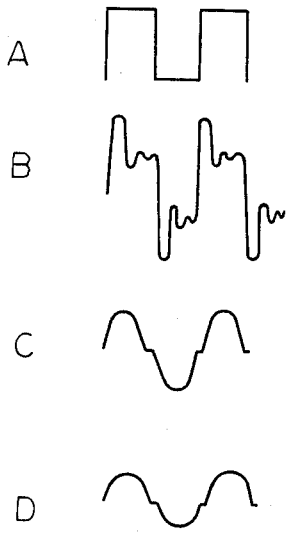
FIGS. 5A, 5B, 5C and 5D are waveform diagrams for illustrating the operation of a power supply apparatus for a fluorescent lamp according to the present invention.

Capacitor 32 serves to generate a ringing oscillation voltage across fluorescent lamp 12 when power is switched on initially, i.e. prior to ignition, when fluorescent lamp 12 is in a high-impedance state. This is illustrated by the waveforms of FIGS. 5A to 5D. FIG. 5A illustrates the waveform of the square-wave high-frequency drive voltage appearing between outputs 29*a* and 29*b* in FIG. 4, and FIG. 5B shows the ringing (i.e. damped osicllation) voltage which is developed across capacitor 12 and hence across fluorescent lamp 12 (due to the low impedance presented by capacitor 31 to the high-frequency ringing voltage) prior to ignition of fluorescent lamp 12. As indicated, the peak-to-peak value of this ringing voltage is approximately twice the peak-to-peak level of the high-frequency drive voltage. As a result, ignition of fluorescent lamp 12 is reliably accomplished. When ignition takes place, then the impedance of fluorescent lamp 12 drops substantially, so that the waveform appearing across the lamp becomes as shown in FIG. 5C, i.e. takes a substantially sinusoidal waveform as a result of the action of the series-resonance circuit constituted by inductor 30 and capacitor 31. The current which flows through fluorescent lamp 12 in this case has a correspondingly sinusoidal waveform, as shown in FIG. 5D.

A suitable frequency for the high-frequency drive voltage is in the range 10 to 20 KHz. Assuming a line power voltage of 100 V AC, the value of the high-frequency drive voltage appearing between outputs 29*a* and 29*b* in FIG. 4 will be approximately 120 V p-p. The effective voltage of such a high-frequency drive voltage will be one-half of this, i.e. 60 V. In the case of a 20 watt fluorescent lamp, a drive voltage having an effective value within the range 55 to 60 V is required for operation, after ignition has been established. However in order to reliably ensure ignition, it is necessary to apply an effective voltage which is of the order of twice that value (i.e. approximately 120 V) before ignition takes place. With a power supply apparatus according to the present invention, the ringing voltage generated by the combination of inductor 30 and capacitor 32 will result in a voltage of approximately 240 V p-p being applied across the fluorescent lamp for this example, prior to ignition. Thus, ignition will be safely ensured, without the need to provide an excessively high amplitude for the high-frequency drive voltage, and hence without energy being wasted. After ignition is established, the voltage appearing across fluorescent lamp 12 will attain a sinusoidal waveform at a level which is slightly less than 120 V p-p, with the value being determined by the effective impedance presented by the series-resonance circuit comprising inductor 30 and capacitor 31.

In this way, reliable operation is ensured without the necessity to produce a large voltage drop across a ballast impedance, and hence with reduced energy consumption. If for some reason the lamp should become extinguished while in operation, then a ringing voltage will again be generated upon the next voltage transition of the high-frequency drive voltage, of sufficient amplitude to ensure immediate re-triggering of the fluorescent lamp.

The capacitance value of capacitor 32, which will be designated as C2, should preferably be such that the resonant frequency of the series-resonance circuit comprising inductor 30 and capacitor 32 is in the range of from twice to ten times the frequency F of the high-frequency drive voltage appearing between outputs 29*a* and 29*b*. That is to say, the value of capacitor 32 should meet the relationship:

$$3F < \tfrac{1}{2}\pi\sqrt{L \cdot C2}$$

If the value of capacitor 32 is excessively high, then current will be shunted through that capacitor while the flourescent lamp is in operation, leading to a lowering of efficiency. It has been found that a value for the capacitance of capacitor 32 which is of the order of 1/10 of the capacitance of capacitor 31 is preferable.

It will be apparent that the order in which inductor 30 and first capacitor 31 are connected can be reversed from that shown in FIG. 4. However, whichever order is adopted, capacitor 32 must be connected to the output terminal, designated as 30*a*, of inductor 30.

In some cases, capacitor 32 can be omitted as a discrete component, i.e. this may be formed by stray capacitance, with appropriate adjustment of the wiring layout if necessary.

The following combination of component values has been found to provide good results:

$$F=17.5\ \text{KHz},\ L=840\ \mu H,\ Cl=0.06\ \mu F,\ C2=0.0068\ \mu F.$$

Experiments have been performed in which the conventional resistor ballast of a commercially available fluorescent lamp was removed and replaced by a power supply apparatus according to the present invention. Using the resistor ballast, an illumination level of 1000 lux at a power consumption of 36 watts was obtained. However, using the power supply apparatus according to the present invention, an illumination level of 1200 lux was obtained, with a power consumption of 12.5 watts. That is to say, it was definitely proven that the the efficiency of operation of this fluorescent lamp was improved by 3.5 times, through use of the power supply apparatus according to the present invention.

Figure 6:
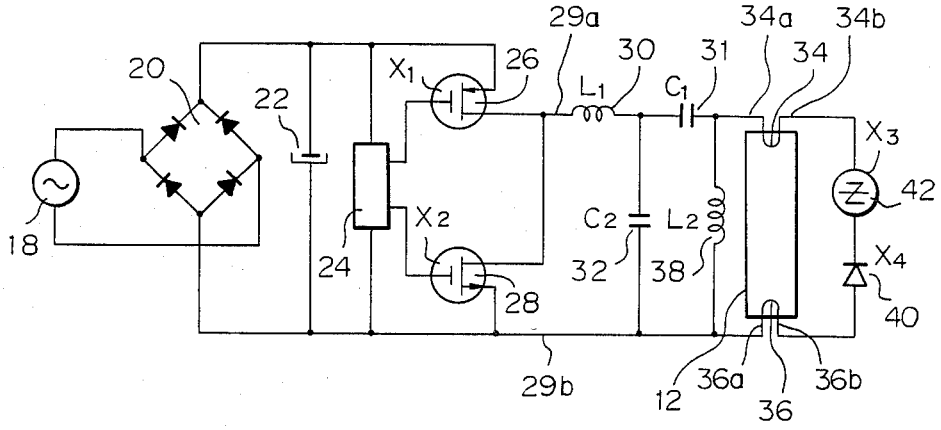
FIG. 6 is a general circuit diagram of a second embodiment of a power supply apparatus for a fluorescent lamp according to the present invention.

FIG. 6 shows another embodiment of the present invention, which is similar to the first embodiment described above, (with corresponding components being indicated by identical reference numerals) but further comprises means for applying preheating power to filaments 34 and 36 of fluorescent lamp 12. These means comprise a diode 40 and a two-terminal thyristor 42 which are connected in series across filaments 34 and 36 as shown, and a choke coil 38 which is also connected between the filaments, but on the opposite side of each from the series-connected diode and two-terminal thyristor. More specifically, choke coil 38 is connected between input terminals 34*a* and 36*a* of filaments 34 and 36 respectively, while the series-connected combination of two-terminal thyristor 42 and diode 40 is connected between output terminals 34*b* and 36*b* of filaments 4 and 36 respectively. Choke coil 38 presents a sufficiently high impedance at the frequency of the high-frequency drive voltage that a negligible level of current is bypassed through this coil.

After power to the apparatus is switched on, prior to ignition of lamp 12, the impedance of fluorescent lamp 12 is extremely high. Thus, the level of the high-frequency drive voltage appearing across the series-connected diode 40 and two-terminal thyristor 42 is sufficiently high to produce breakdown of thyristor 42 during each half-cycle of forward conduction by diode 40. As a result, a DC current component flows through diode 40, thyristor 42, through filaments 34 and 36, with the current return path being completed by choke coil 38. Preheating of filaments 34 and 36 is thereby implemented. When ignition of fluorescent lamp 12 occurs, then the impedance developed by lamp 12 falls as described above, whereby the voltage level developed across the lamp becomes insufficient to produce breakdown of two-terminal thyristor 42. Thus, current ceases to flow through filaments 34 and 36.

It can thus be understood that the power supply apparatus according to the present invention can be adapted to provide extremely simple yet effective means for automatic preheating of the fluorescent lamp filaments before lamp ignition.

From the above description, it can be understood that a power supply apparatus for a fluorescent lamp according to the present invention enables a substantial degree of reduction of energy consumption to be achieved, with only about from $\frac{1}{2}$ to $\frac{1}{3}$ of the power being required to drive a fluorescent lamp by comparison with conventional drive arrangements. It can also be understood that such a power supply apparatus can be of very simple configuration, and can therefore be manufactured at low cost.

Although the present invention has been described in the above with reference to specific embodiments, it should be noted that various changes and modifications to the embodiments may be envisaged, which fall within the scope claimed for the invention as set out in the appended claims. The above specification should therefore be interpreted in a descriptive and not in a limiting sense.

What is claimed is:

1. A power supply apparatus for a fluorescent lamp, comprising:

inverter means coupled to a source of AC line power, for converting said AC line power to a high-frequency drive voltage having a substantially square waveform, produced from first and second outputs thereof;

an inductor and a first capacitor connected in series between said inverter means and a first filament of said fluorescent lamp, for supplying said high-frequency drive voltage to said fluorescent lamp, with the capacitance of said first capacitor and the inductance of said inductor forming a series resonant circuit whose frequency of resonance is higher than but less than twice the value of the frequency of said high-frequency drive voltage, and;

a second capacitor connected between an output terminal of said inductor and a second filament of said fluorescent lamp, with the capacitance value of said second capacitor being lower than that of said first capacitor.

2. A power supply apparatus for a fluorescent lamp according to claim 1, in which the capacitance C1 of said first capacitor, the inductance L of said inductor and the frequency F of said high-frequency drive voltage satisfy the following relationship:

$$1.2F<\tfrac{1}{2}\pi\sqrt{LC1}<2F;\ \text{and,}$$

the capacitance value C2 of said second capacitor satisfies the following relationship:

$$3F<\tfrac{1}{2}\pi\sqrt{LC2}$$

3. A power supply apparatus for a fluorescent lamp according to claim 1, in which said series-connected inductor and first capacitor are connected between said first output of said inverter circuit means and a first terminal of said first filament of said fluorescent lamp and said second output of said inverter circuit means is connected to a first terminal of said second filament of said fluorescent lamp, and further comprising:

a choke coil connected between said first terminals of said first and second filaments; and a two-terminal thyristor and a diode connected in series between second terminals of said first and second filaments.

* * * * *